US005549303A

United States Patent [19]

Kastner

[11] Patent Number: 5,549,303

[45] Date of Patent: Aug. 27, 1996

[54] LIQUID-SHOOTING TARGET GAME

[76] Inventor: Thomas J. Kastner, 596 Brandy CP Rd., Kersey, Pa. 15846

[21] Appl. No.: 498,031

[22] Filed: Jul. 3, 1995

[51] Int. Cl.[6] ..... A63F 9/02; F41J 1/00

[52] U.S. Cl. ..... 273/349

[58] Field of Search ..... 273/349

[56] References Cited

U.S. PATENT DOCUMENTS

| | | | |
|---|---|---|---|
| 3,336,030 | 8/1967 | Martell et al. | 273/349 |
| 3,342,492 | 9/1967 | Barrett | 273/349 |
| 3,434,716 | 3/1969 | Schwartz | 273/349 X |
| 3,434,717 | 3/1969 | Schwartz | 273/349 |
| 3,572,712 | 3/1971 | Vick | 273/349 |
| 4,040,622 | 8/1977 | Sinnott | 273/349 |
| 4,103,436 | 8/1978 | Strussion et al. | 434/151 |
| 4,176,473 | 12/1979 | Rae | 434/429 |
| 4,248,436 | 2/1981 | Corrigan | 273/349 |

*Primary Examiner*—William H. Grieb

*Attorney, Agent, or Firm*—George C. Atwell

[57] ABSTRACT

A liquid-shooting target game is disclosed which includes a flat, vertical panel foldable into sections and which is unfolded for disposition in an upright position on a floor or table surface. A flat, horizontal panel is attached to the lower end of the vertical panel and lays upon the floor or table surface. On the facing surface of the vertical panel are scenes of natural habitats from various geological eras. The vertical panel also includes a plurality of apertures formed thereon whose contours define the physical shape of fauna found in the particular habitat of the geologic era depicted on the vertical panel. A plurality of hollow figurines are provided so that each figurine can be inserted into the corresponding aperture. In addition, each figurine has a hole on its body so that a continuous jet of liquid shot from a squirt pistol held by a player can enter and fill the figurine. Each player shoots his or her squirt gun at a respective figurine, and a timer is used to demarcate the start and finish of the game so that the player whose figurine is filled with the most liquid when the timer sounds is declared the winner of the game.

16 Claims, 4 Drawing Sheets

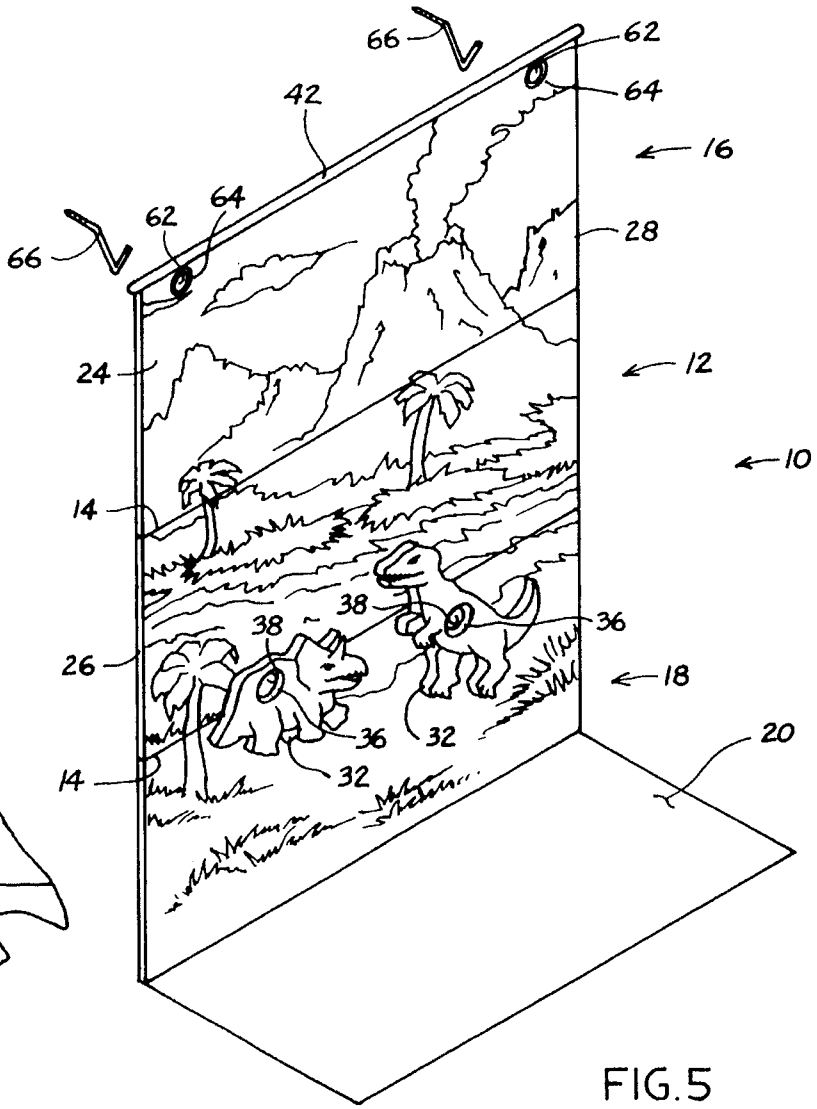
FIG. 5
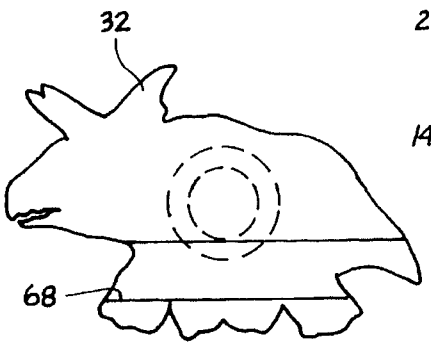
FIG. 4
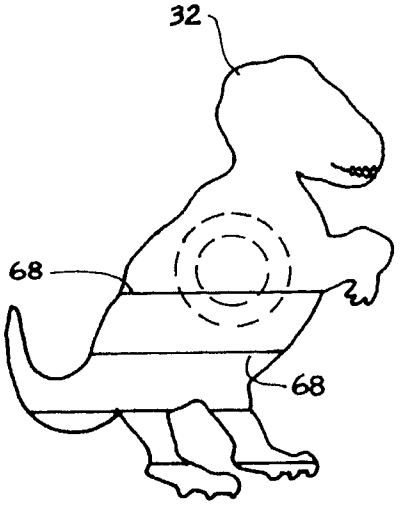

LIQUID-SHOOTING TARGET GAME

BACKGROUND OF THE INVENTION

This invention relates to children's games, and more particularly pertains to a liquid-shooting target game for children.

Among the games most popular with children are games involving the use of water. For example, games involving the use of water include a game of tag or volleyball in a swimming pool or a disorganized, free-for-all game wherein children make use of a water hose to squirt each other on an ardent summer day. In addition, the use of water guns and pistols by children to squirt and soak each other in either an organized game of hide-and-seek or a disorganized melee is one of the most common and popular forms of amusement involving water and children. Moreover, games involving the use of water pistols and guns are still popular—even in the age of CD players and home video games.

Furthermore, a wide variety of water games for children have been invented which involve the use of water pistols and guns and targets at which jets of water from the pistols and guns are aimed to effect some result—knocking a target down or causing an alarm or buzzer to ring when struck by the jet of water—in the process of playing the game and determining a winner.

For example, the Martell et al. U.S. Pat. No. 3,336,030 discloses a gun and target game whereby jets of water are aimed at a target to effect the inflation of a balloon. The Barrett U.S. Pat. No. 3,342,492 discloses a water gun target game wherein a jet of water raises a ball in a tube. The Schwartz U.S. Pat. No. 3,434,717 discloses a water gun target game which utilizes a stream of water from a water gun to strike a target and cause a sound to be elicited. The Vick U.S. Pat. No. 3,572,712 discloses a moving target and water gun game wherein jets of water from a water gun strike a target to complete a circuit which causes a figurine to move along a vertical ladder. The Sinnott U.S. Pat. No. 4,040,622 discloses a water gun game involving water guns and a water pan and the Corrigan U.S. Pat. No. 4,248,436 discloses an amusement device wherein a jet of water shot from a water gun causes a bubble to burst.

However, despite the ingenuity of the foregoing games, there remains a need for a water game which is easy to set up, store and transport, a water game which is simple in operation, and enjoyable and wholesome for children to play.

The present invention comprehends a liquid-shooting target game for children which comprises a flat, vertically-extending panel which is capable of being folded into sections and is also unfolded for disposition in an upright position on a floor, table, or ground surface. Integrally attached at the lower end of the vertical panel is a horizontal panel which is also foldable and partially rests upon the ground or floor surface when the vertically-extending panel is disposed in the upright position. In order to support the vertical panel, a support rod is attached to the back of the vertical panel at the upper end thereof with the lower end of the support rod secured into a base resting on the ground or floor surface.

On the facing surface of the vertically-extending panel are graphic representations of scenes from habitats particular to various geologic eras or periods. Scenes featuring dinosaurs and their habitat would be a favorite graphic representation for the vertical panel. In addition to depictions of flora and fauna from a particular geologic era or period, the vertical panel includes a plurality of apertures whose contours define the shape of a creature particular to that respective geologic era or period. For example, if the scene depicted on the vertical panel were of the Cretaceous period of the Mesozoic era, the contours of the apertures could define the shape of a Tyrannosaurus Rex and a Triceratops. The game is also provided with a plurality of hollow, plastic figurines, each of which is insertably removable into the appropriate aperture. The figurines are held in place within the apertures by clips on the feet of the figurines. Also, each figurine includes a small, circular recess surrounding a target hole on the body of the figurine anti through which a continuous jet or stream of liquid can enter to fill the figurine.

The liquid shooting target game also includes a plurality of water squirt pistols, and each pistol has a decorative figurine head which is mounted to the end of the barrel and through which the jet of liquid can pass when the pistol is aimed at the target hole of a particular figurine. A timer is used to determine the length of time the players have to fill the figurines with liquid, and the player whose figurine contains the most liquid when the timer sounds is declared the winner of the game.

It is an objective of the present invention to provide children with a simple, enjoyable water game which is easy to set up and play.

Another objective is to provide a water game which can be played while hung from a wall or mounted on a floor surface.

A further objective is to provide a children's water game which is enjoyable to play and also improves eye-hand coordination and skill.

These and other objects, features, and aspects of the present invention may be better understood from the following detailed description of the preferred embodiment when read in conjunction with the appended drawing figures.

BRIEF DESCRIPTION OF THE DRAWINGS

FIG. 4 is a rear elevational view of the figurines first shown in FIG. 1 illustrating volume gradation lines on the figurines;

FIG. 5 is a frontal perspective view of the target game first shown in FIG. 1 illustrating an alternative manner to support the game.

DETAILED DESCRIPTION OF THE PREFERRED EMBODIMENT

Illustrated in FIGS. 1–5 is a liquid-shooting target game 10 designed for children ranging in age from approximately 4 to 12. The game 10 can be played both indoors and outdoors and is simple enough in construction and design that the game 10 can be set up by the children themselves. The various structural elements of the game 10 may be manufactured from a molded plastic or a heavy-duty vinyl plastic in order to be light-weight, durable and resistant to the otherwise corrosive and harmful effects of water. Because it is designed to appeal to children, the game 10 incorporates eye-catching artistic motifs which augment its appeal for children.

Figure 1:
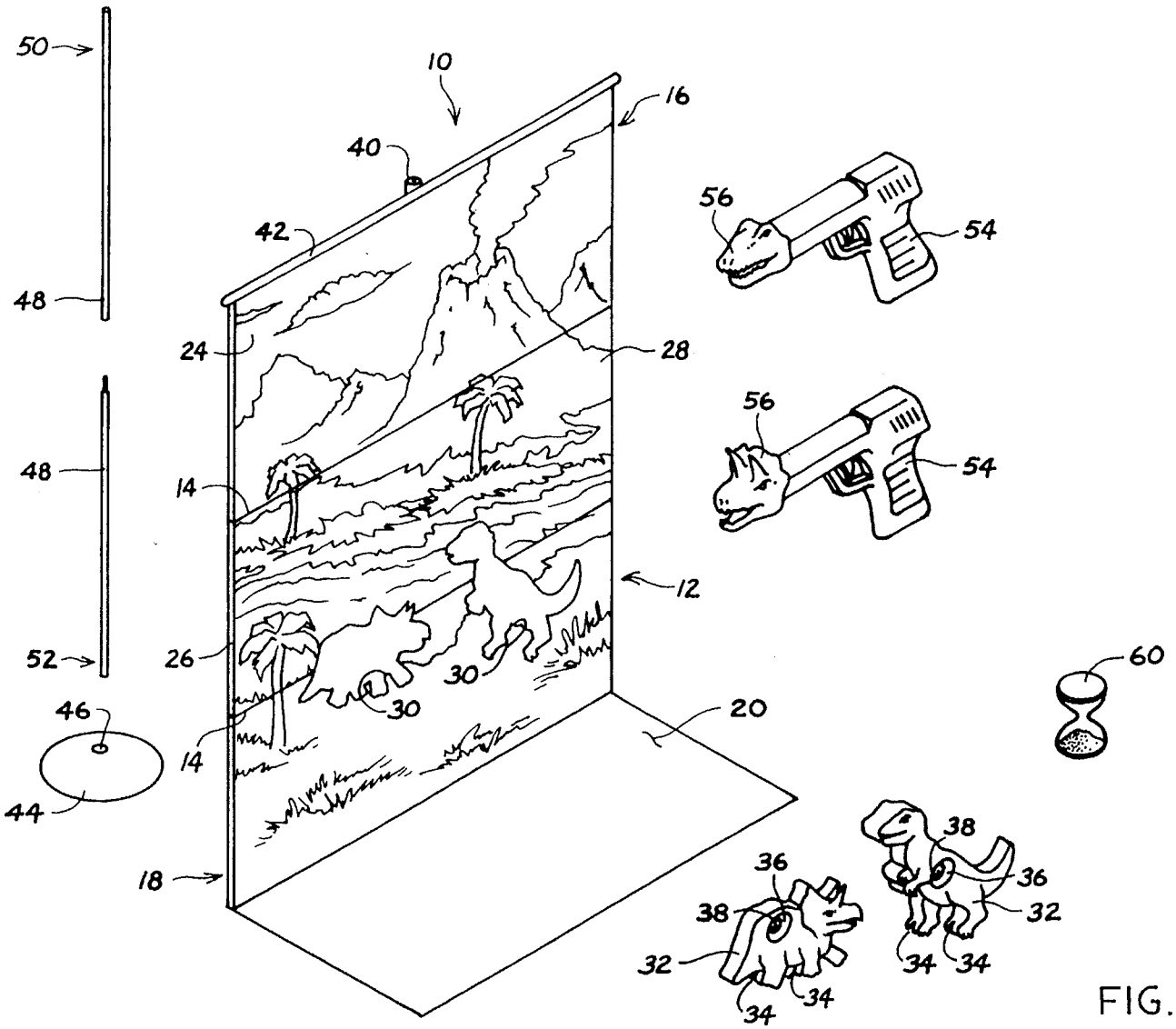
FIG. 1 is a frontal perspective view of the liquid-shooting target game of the present invention.
Figure 3:
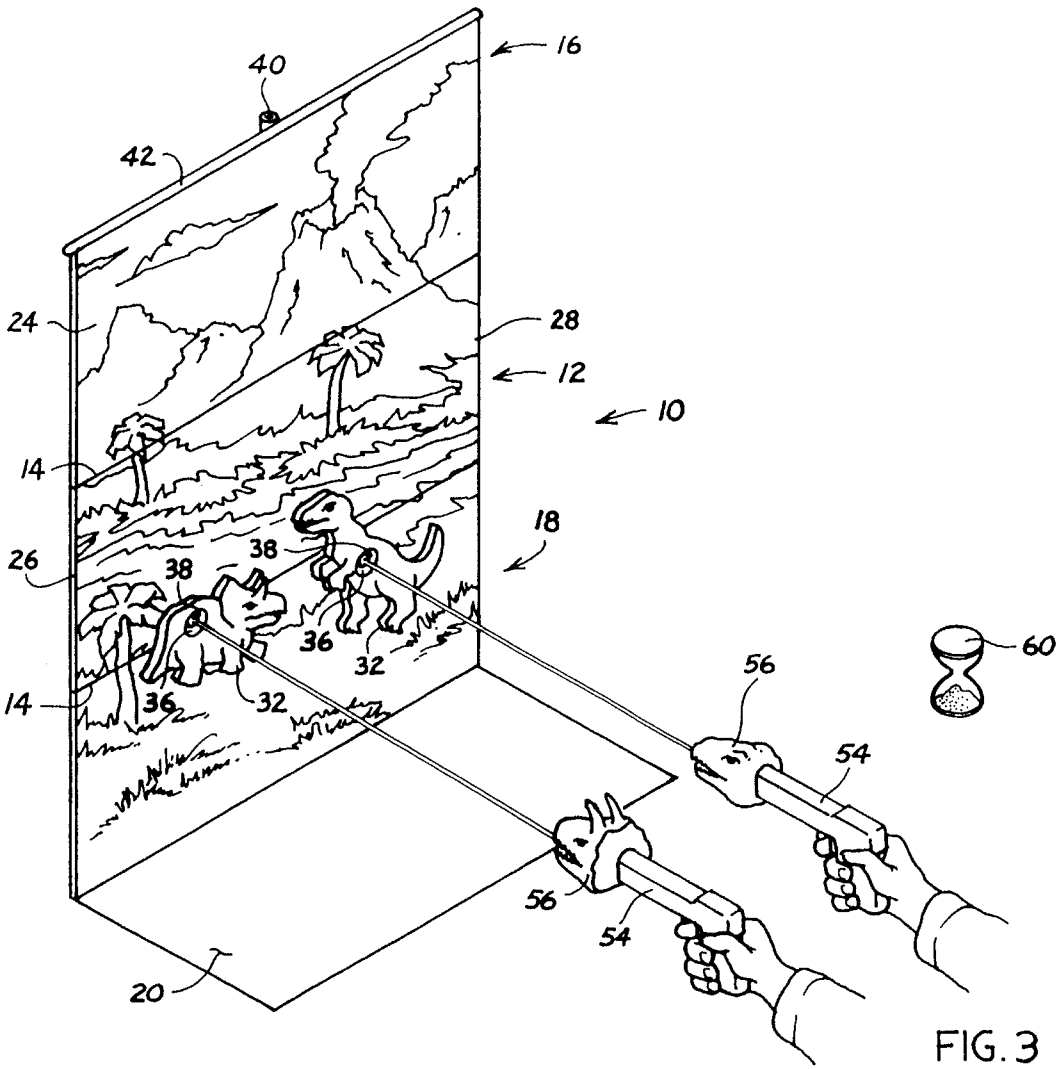
FIG. 3 is a frontal perspective view of the target game first shown in FIG. 1 illustrating two players shooting water pistols at figurines supported on the vertical panel.
Figure 2:
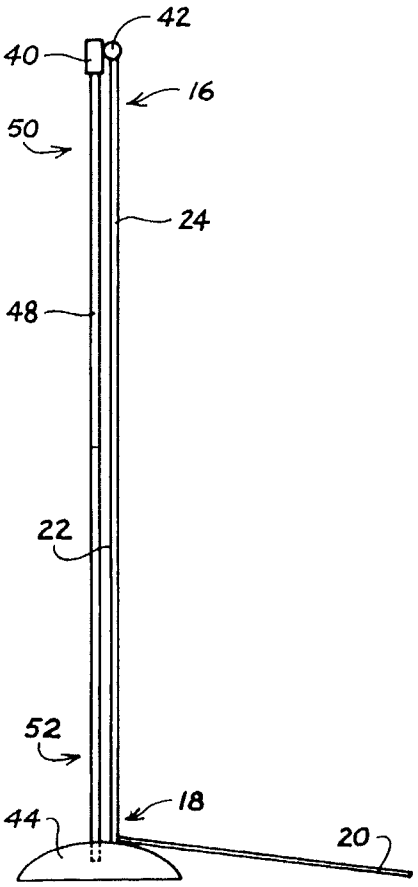
FIG. 2 is a side elevational view of the liquid-shooting target game first shown in FIG. 1.

As illustrated in FIGS. 1–3, the game includes a flat, vertically-extending panel 12 which is capable of being folded into sections for storage and transportation, and is also capable of being unfolded for upright disposition on, for example, a floor, table, or ground surface. In the present embodiment of the game 10, the panel 12 includes two vertical creases 14 which permit the panel 12 to be foldable into three equal sections. The panel 12 further includes an upper panel end 16 and an opposite lower panel end 18, and, integrally attached to the lower panel end 18 is a flat, horizontally-extending floor cover 20 which rests upon the floor or ground surface when the game 10 is set up for play. The floor cover 20 is also foldable and helps to support the vertical panel 12 when the game 10 is set up for play as well as directing water away from the area surrounding the floor cover 20 during play of the game 10.

As shown in FIGS. 1, 3, and 5, the panel 12 includes a rear surface 22 and a facing surface 24, and the two spaced-apart, horizontal creases 14 extend from one vertical edge 26 of the panel 12 to an opposite vertical edge 28. When not in use, the game 10 can be folded for storage in a box by folding the panel 12 at the creases 14 and then resting the folded portions of the panel 12 on the floor cover 20.

In order to enhance the appeal of the game 10 for children, the facing surface 24 of the panel 12 may include colorful artistic representations pertaining to various subject matter. Among the subject matter most appealing to children are artistic renderings from the Mesozoic Era—the era of the dinosaurs. Thus, on the facing surface 24 of the panel 12 flora and fauna from the dinosaur age are artistically represented and these artistic representations will be related to other elements of the game 10 as the description of the game 10 proceeds. The panels 12 shown in FIGS. 1 and 5 include illustrations of several examples of tropical flora, several mountains, and a billowing volcano. The artistic depictions illustrated on the facing surface 24 in FIGS. 1 and 5 are examples only and many other artistic depictions or renderings are possible—both from the dinosaur era and other geologic eras and periods.

The panel 12 includes a plurality of apertures 30 formed thereon and whose contours define the outlines or shapes of animals corresponding to the background scenery depicted on the facing surface 24. The two apertures 30 shown in FIGS. 1, 3, and 5 define the contours or shapes of animals particular to the Cretaceous period of the Mesozoic Era. The panel 12 can accommodate more apertures if so desired so long as the structural stability of the panel 12 is not impaired. Specifically, the apertures 30 illustrated in FIGS. 1, 3, and 5 define the shapes or contours of a Triceratops and a Tyrannosaurus Rex, as these are dinosaurs familiar to all children. Adapted for removable insertion or placement within the apertures 30 are a plurality of hollow, plastic figurines 32, each of which is insertably removable into the appropriately-shaped aperture 30. As shown in FIGS. 1, 3, and 5, the figurines are three-dimensional, hollow, plastic objects in the shapes and forms of a Triceratops and a Tyrannosaurus Rex. The figurines 32 fit within the apertures 30 and include hinges or clips 34 on their limbs which permit attachment of the limbs of the figurines 32 to the panel 12 itself. Thus, the figurines 32 are removably insertable into the appropriate apertures 30 and are supported by the panel 12.

While the figurines 32 of the game 10 are in the form of dinosaurs, the figurines 32 can be in the shape of any animal conceivable so long as the figurines 32 are congruent with the artistic depiction on the facing surface 24 of the panel 12 and correspond to apertures 30 in which they can be placed. Each figurine 32 includes on its body surface a circular depression, cavity, or recess 36 which surrounds a target hole 38 on the body surface of the figurine 32. A liquid, such as water, when forcibly projected as a continous jet or stream, can enter the target hole 38 and fill a portion of the interior of the body of the figurine 32.

As illustrated in FIGS. 1 and 2, a means to support the panel 12 in its upright and vertical disposition during actual play of the game 10 is included. The means to support the panel 12 includes a securement member 40 attached to the upper end 16 of the rear surface 22. The securement member 40 need only be a female threaded member attached to an uppermost horizontal edge 42 of the panel 12. In addition to the securement member 40, the means to support the panel 12 includes a circular base member 44 which is disposed on the ground surface adjacent the lower end 18 of the panel 12. The base member 44 also includes a centrally-located hole or aperture 46. The means to support the panel 12 further includes an elongated support rod 48 which may be a one-piece rod or, as shown in FIGS. 1 and 2 of the present invention, a two-piece member which is secured together in order to extend from the base member 44 to the securement member 40. Specifically, the support rod 48 shown in FIGS. 1 and 2 has an upper end 50 which is removably attachable to the securement member 40 and an opposite lower end 52 which is removably attachable within the aperture 46 the base member 44.

In order to actually play the game 10, a means to fill the figurines 32 with liquid must be utilized after the figurines 32 are inserted into the apertures 30 for supporting by the panel 12. The means to fill the figurines 32 with liquid employed by the present invention includes a plurality of liquid squirt guns 54 as shown in FIGS. 1 and 3. The squirt guns 54 may be of the standard plastic kind found in any department store. To enhance the appeal of the game 10 and to further advance the dinosaur motif, the game 10 includes a plurality of decorative figurine covers 56 for placement over the barrels of the squirt guns 54. The figurine covers 56 shown in FIGS. 1 and 3 depict the head of a Tyrannosaurus Rex and the head of a Triceratops and correspond to the dinosaur figurines 32 previously described.

Obviously, the decorative covers 56 could be in the shape of any animal, and should preferably correspond to the figurines 32 and the artistic depiction on the panel for the particular geologic era or period. The covers 56 are placed over the barrels of the squirt guns 54 and include a slot or bore extending from the rear of the covers 56 through the open mouth portion which thereby allows a jet or stream of liquid to pass therethrough when the guns 54 are aimed at the figurines 32 and the trigger is squeezed to shoot the jet of liquid.

As shown in FIGS. 1 and 3, the game 10 includes a timing means to determine a fixed unit or interval of time in which the figurines 32 can be filled with liquid and play of the game 10 can occur. The timing means employed by the game 10 includes an hourglass-shaped egg timer 60. However, any sort of timing means can be used, such as a stop watch, an electric timer, and a clock or timer located on a microwave oven or a cooking stove or range.

Illustrated in FIG. 5 is an alternative embodiment of the game 10 which allows the game 10 to be played while suspended from a wall or overhead surface. In this embodiment the game 10 includes a means for suspending the panel 12 from a wall or overhead surface. The means for suspending the panel 12 includes a plurality of hanging apertures 62 located adjacent the upper end 16 of the panel 12. In FIG. 5, two spaced-apart hanging apertures 62 are shown located adjacent the upper end 16 of the panel 12 at, respectively, the upper right-hand corner and the opposite upper left-hand corner. Each aperture 62 includes a grommet 64 for support and, although the panel 12 can include more than two apertures 62, because of the lightweight nature of the panel 12 and the hollow figurines 32, only two apertures 62 are necessary. In addition to the apertures 62, the means for suspending the panel 12 includes a plurality of panel hanging members 66 which are mounted to the wall or the overhead surface for suspending the panel 12 therefrom. The hanging members 66 can be hooks, as shown in FIG. 5, or can be various other types of hooks or hangers found at any hardware store. When the panel 12 is suspended from the wall or the overhead surface by the hanging members 66 being inserted through the hanging apertures 62, the floor cover 20 will hang downward in the same vertical plane as the panel 12.

In order to play a round of the game 10, an appropriate setting should first be found. Although the game 10 can be played indoors, it is probably better to set up the game 10 outdoors where the splashing of water will not cause as much harm. After a suitable location has been found to set up the game 10, the first step is to assemble the support rod 48 and attach the lower end 52 to the base member 44 while screwing in the upper end 50 to the securement member 40 located on the rear surface 22 of the panel 12. The support rod 48 and base member 44 are all that are necessary to support the panel 12 in its upright vertical disposition. The figurines 32 can then be inserted into the appropriate apertures 30 for mounting to the panel 12. The timing means is then set so that a fixed unit or interval of time can elapse for play of the game 10. The squirt guns 54 are filled with water and the figurine covers 56 are pressed onto the barrels of the squirt guns 54.

As shown in FIG. 4, the rear of each figurine 32 includes several horizontal gradation lines 68 which measure the volume of water that has entered through the target hole 38 located on the body of each figurine 32. Each player—in this embodiment of the game 10 two players can compete against each other—is then positioned a fixed distance away from the panel 12 until instructed to aim his/her squirt gun 54 at the respective figurine 32 mounted to the panel 12. At a signal from the individual instructing the play of the game 10, the players then aim and squirt their guns 54 at the respective circular recess 36 located on the body of the appropriate figurine 32. As soon as the individual supervising the game 10 gives the signal for the players to begin shooting at the figurines 32 to fill them with water, the timing means commences counting down a short interval of time, approximately sixty to ninety seconds, within which the players may shoot their squirt guns 54 in order to fill their appropriate target figurines 32. The first player to fill his/her own target figurine 32 with the most water, either before the timer 60 sounds or when the timer 60 sounds, is declared the winner. The target figurines 32 can be filled to the target hole 38 on the body thereof. The gradation lines 68 are used to determine which figurine 32 has been filled with the most water if neither player has filled his/her figurine 32 to the target hole 38 before the timer 60 sounds. The figurines 32 can then be removed from the panel 12, emptied of water, placed back into their appropriate apertures 30, and the squirt guns 54 can be refilled with water and the timer 60 reset for another game.

Figure 6:
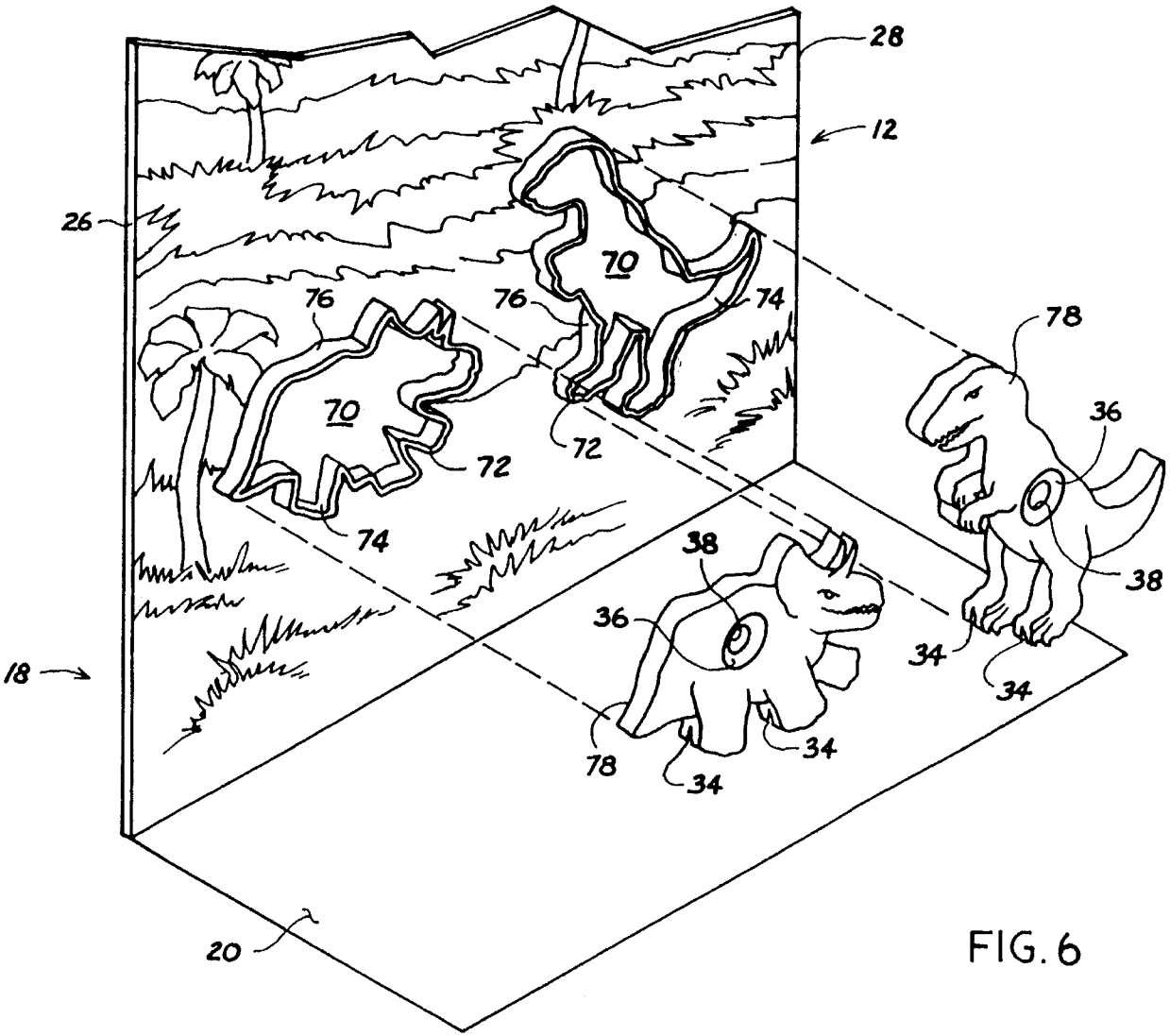
FIG. 6 is an enlarged perspective view of an alternative embodiment for structural components first shown in FIG. 1.

In FIG. 6, an alternative embodiment to the game 10 is illustrated. In this embodiment, the apertures 30 and the figurines 32 have been modified. In FIG. 6, the apertures 30 are eliminated so that the panel 12 extends as one continuous solid member from the upper end 16 to the lower end 18. The panel 12 will include pictures or representations of the same distinctive flora and fauna shown in FIGS. 1–5. In order to replace the apertures 30, a plurality of flat plates 70 are glued or otherwise attached to the continuous, solid facing surface 24 of the panel 12. The plates 70 may be made out of plastic or aluminum and are shaped and formed so that their contours define the outlines of dinosaurs. In FIG. 6, the contours of the plates 70 define two well-known dinosaurs—Triceratops and Tyrannosaurus Rex. Each plate 70 includes an upraised lip 72 which follows the contour of the plates 70. The lips 72 need to project out from the plates 70 approximately one-eighth-inch to one-quarter-inch. The inside or outside peripheral surfaces 74 and 76 of the lips 72 may have a seal or gasket affixed thereto and running along the peripheral inside surface 74 or outside surface 76 of the lips 72.

In addition, the figurines 78 shown in FIG. 6 have been modified from the figurines 32 shown in FIGS. 1–5. The figurines 78 of FIG. 6 are essentially hollow plastic shells with their backsides removed, however, the figurines 78 may still include clips or hinges 34 on their limbs to facilitate attachment to the lips 72. The figurines 78 are designed to be press-fitted, hinged, or snapped to the inner surface 74 or the outer surface 76 of the lips 72 in the same manner a plastic lid fits onto a plastic container. The seal or gasket on the surface 74 or 76 provides a watertight seal when the figurines 78 are placed thereon contiguous to either of the surfaces 74 and 76 of the lips 72 so that an interior chamber for holding and temporarily storing liquid is formed between the figurines 78 and the plates 70 and lips 72.

In order to play the game illustrated in FIG. 6, the panel 12 would be disposed on the ground or floor surface and the upper end 50 of rod 48 would be pressed or screwed into the threaded member or blind hole of member 40 while the lower end 52 would be pressed or screwed into the threaded hole or aperture 46 of member 44. With the panel 12 now disposed in an upright vertical position, the figurines 78 are placed onto the lips 72 of the plates 70. The guns 54 are filled with water and the players are positioned a given distance from the panel 12. It should be noted that the covers 56 may be integrally formed to the barrels of the guns 54 as one solid mold. The timer 60 is set and, at a signal or command, the players would start shooting water from their guns 54 at the respective recesses 36 of the figurines 78 in order to fill the enclosed area or chamber between the plates 70, the lips 72, and inner body surfaces of the Figurines 78. Whoever has filled his or her figurine 78 with the most water either before or at the sounding, signaling, or indication of the timer 60 is declared the winner. The figurines 78 can then be removed from the lips 72 to allow the water to drain out, the timer 60 can be reset and the guns 54 can be refilled so that another round of the game 10 can be played.

The invention has been disclosed in terms of both a preferred and an alternative embodiment which fulfills each and every one of the objects of invention as set forth hereinabove and provides a new and improved target game for children's enjoyment. Of course, various changes, modifications, and alterations in the teachings of the present invention may be contemplated by one skilled in the art without departing from the spirit or scope thereof.

I claim:

1. A liquid-shooting target game, comprising:

a flat, vertically-extending panel having a plurality of apertures formed thereon and having contours which define flora and fauna from a geologic era.

a plurality of target figurines adapted for removable insertion into the apertures for supporting by the panel, each target figurine including a chamber for storing a liquid;

means to support the panel in a vertical disposition; and means to fill the figurines with the liquid when the figurines are inserted into the apertures for supporting by the panel.

2. The target game of claim 1 wherein the means to support the panel includes a securement member attached to the upper end of the rear surface of the vertically-extending panel.

3. The target game of claim 1 wherein the means to support the panel includes a base member disposed adjacent the lower end of the vertically-extending panel.

4. The target game of claim 3 wherein the means to support the panel includes an elongated support rod having an upper rod end attachable to the securement member and a lower rod end attachable to the base member.

5. The target game of claim 1 wherein the means to fill the figurines includes a plurality of liquid squirt guns.

6. The target game of claim 5 further comprising a plurality of decorative figurine covers for placement over the barrels of the liquid squirt guns and which allow liquid to pass therethrough when the guns are aimed at the panel.

7. The target game of claim 1 further comprising a timing means for determining a fixed unit of time in which the figurines can be filled with liquid.

8. A liquid-shooting target game for suspension from a wall or overhead surface, comprising:

a flat, vertically-extending panel having an upper end, a lower end, and a plurality of apertures formed thereon and having contours which define flora and fauna from a geologic era;

a plurality of target figurines adapted for removable insertion into the apertures so that the figurines are supported by the panel and each figurine including a chamber for storing a liquid;

means to fill the figurines with the liquid when the figurines are inserted into the apertures and supported on the panel;

a timing means to determine a fixed interval of time in which the figurines can be filled with the liquid; and means for suspending the panel from the wall and the overhead surface.

9. The target game of claim 8 wherein the means for suspending the panel from the wall includes a plurality of hanging apertures located at the upper end of the panel.

10. The target game of claim 9 wherein the means for suspending the panel from the wail includes a plurality of panel hanging members for insertion through the hanging apertures.

11. The target game of claim 10 wherein the panel hanging members are mounted to the wall for suspending the panel therefrom.

12. The target game of claim 11 wherein the panel hanging members are attached to the overhead surface for suspending the panel therefrom.

13. A liquid-shooting target game, comprising:

a flat, vertically-extending panel containing a graphic representation of flora and fauna from a particular geologic era;

a plurality of plates attachable to the panel with the contours of each plate defining a specific type of fauna related to the graphic representations of the geologic era on the panel;

a plurality of target figurines for removable attachment to the plates with each target figurine in the form of a specific type of fauna related to the graphic representation of the geologic era on the panel and each figurine including a chamber for storing a liquid;

means to support the panel in a vertical disposition; and means to fill the target figurines with the liquid when the figurines are attached to the plates.

14. The target game of claim 13 wherein each plate includes a projecting lip extending along the contour of each plate.

15. The target game of claim 14 wherein each target figurine is removably attachable contiguous to the lip of the corresponding plate so that a liquid-tight seal is made between the lip and the target figurine.

16. A liquid-shooting target game for suspension from a wall or overhead surface, comprising:

a flat, vertically-extending panel containing a graphic representation of flora and fauna from a particular geologic era;

a plurality of plates attachable to the panel with the contours of each plate defining a specific type of fauna related to the graphic representations of the geologic era on the panel;

a plurality of target figurines for removable attachment to the plates with each target figurine in the form of a specific type of fauna related to the graphic representation of the geologic era on the panel and each figurine including a chamber for storing a liquid;

means to fill the target figurines with the liquid when the figurines are attached to the plates;

a timing means to determine a fixed interval of time in which the figurines can be filled with the liquid; and means for suspending the panel from the wall or overhead surface.

* * * * *